US008959917B2

(12) United States Patent
Berndt et al.

(10) Patent No.: US 8,959,917 B2
(45) Date of Patent: Feb. 24, 2015

(54) METHOD FOR OPERATING A FORCED-FLOW STEAM GENERATOR OPERATING AT A STEAM TEMPERATURE ABOVE 650°C AND FORCED-FLOW STEAM GENERATOR

(75) Inventors: Thoralf Berndt, Stuttgart (DE); Qiurong Chen, Backnang (DE)

(73) Assignee: ALSTOM Technology Ltd, Baden (CH)

( * ) Notice: Subject to any disclaimer, the term of this patent is extended or adjusted under 35 U.S.C. 154(b) by 323 days.

(21) Appl. No.: 13/387,033

(22) PCT Filed: Jul. 30, 2010

(86) PCT No.: PCT/DE2010/000906
§ 371 (c)(1),
(2), (4) Date: Mar. 29, 2012

(87) PCT Pub. No.: WO2011/015185
PCT Pub. Date: Feb. 10, 2011

(65) Prior Publication Data

US 2012/0272649 A1 Nov. 1, 2012

(30) Foreign Application Priority Data

Aug. 4, 2009 (DE) ..... 10 2009 036 064

(51) Int. Cl.
*F01K 7/22* (2006.01)
*F01K 13/02* (2006.01)
(Continued)

(52) U.S. Cl.
CPC . *F01K 7/22* (2013.01); *F01K 13/02* (2013.01); *F01K 7/34* (2013.01); *F22D 1/325* (2013.01); *F22B 29/00* (2013.01)
USPC ..... 60/677; 60/676; 60/652; 60/667

(58) Field of Classification Search
CPC ..... F22B 35/105; F22B 29/06; F22B 29/10; F22B 29/12; F22D 1/32; F22D 1/325; F22D 1/12; F01K 7/34; F01K 7/325; F01K 13/00; F01K 13/003; F01K 13/02
USPC ..... 60/646, 648, 652, 667, 670, 677, 678
See application file for complete search history.

(56) References Cited

U.S. PATENT DOCUMENTS 3,016,712 A * 1/1962 Taylor ..... 60/676
3,411,300 A 11/1968 Schuetzenduebel et al.
(Continued)

FOREIGN PATENT DOCUMENTS

EP 0 676 532 10/1995
JP 2000-240405 9/2000

OTHER PUBLICATIONS

International Search Report dated Feb. 10, 2011 for PCT/DE2010/000906.
(Continued)

*Primary Examiner* — Thomas Denion
*Assistant Examiner* — Laert Dounis

(57) ABSTRACT

A method for operating a forced-flow steam generator operating at variable pressure and at a steam temperature above 650° C. and reducing the minimum forced-flow load of the forced-flow steam generator, wherein the economizer of the forced-flow steam generator includes at least one high pressure pre-heater and/or a heat transfer system for preheating the working medium, the at least one high-pressure pre-heater and/or the heat transfer system arranged upstream as viewed in the working medium circuit direction, wherein if a predetermined partial load point is exceeded, the heat absorption of the working medium within at least one high-pressure preheater and/or the heat transfer system is reduced so that the temperature of the water/steam working medium at the outlet of the economizer is below the boiling point relative to the corresponding economizer outlet by a predetermined temperature difference, and a forced-flow steam generator for performing the method.

17 Claims, 4 Drawing Sheets

Figure 1:
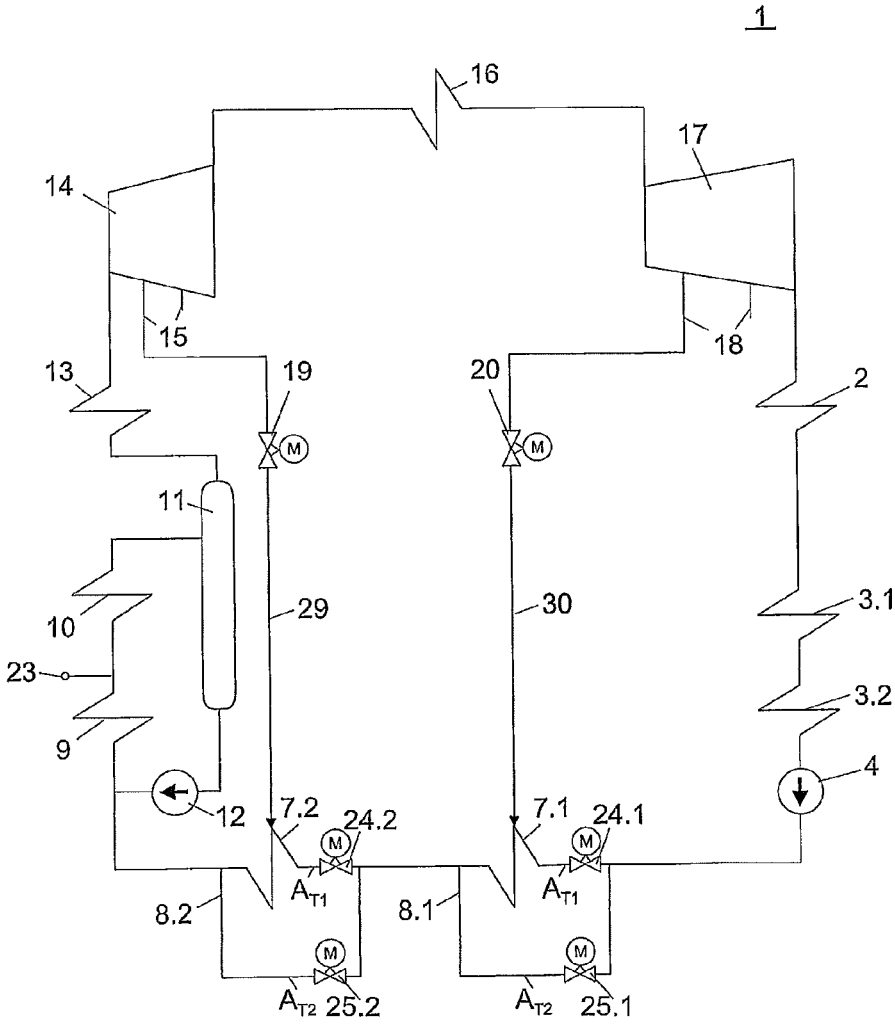

(51) Int. Cl.

| | |
|---|---|
| ***F01K 7/34*** | (2006.01) |
| ***F22D 1/32*** | (2006.01) |
| ***F22B 29/00*** | (2006.01) |

(56) References Cited

U.S. PATENT DOCUMENTS

| | | | | | |
|---|---|---|---|---|---|
| 4,003,205 | A | * | 1/1977 | Matsumura | 60/646 |
| 4,080,789 | A | * | 3/1978 | Frei | 60/658 |
| 4,290,389 | A | | 9/1981 | Palchik | |
| 4,651,533 | A | * | 3/1987 | Ura et al. | 60/678 |
| 5,564,269 | A | | 10/1996 | Briesch | |
| 5,735,236 | A | | 4/1998 | Kastner et al. | |
| 5,906,178 | A | | 5/1999 | Liebig et al. | |

OTHER PUBLICATIONS

First Office Action of the German Patent Office dated Feb. 7, 2011 for German Patent Application 102009036064.6.

* cited by examiner

METHOD FOR OPERATING A FORCED-FLOW STEAM GENERATOR OPERATING AT A STEAM TEMPERATURE ABOVE 650°C AND FORCED-FLOW STEAM GENERATOR

The invention relates to a method for operating a once-through steam generator operating with sliding pressure and at a steam temperature above 650° C. and for lowering its once-through minimum load, the once-through steam generator being incorporated into the water/steam circuit of a power station, and the economizer of the once-through steam generator having upstream, as seen in the water/steam circulation direction, at least one HP preheater and/or one heat transfer system for the further preheating of the feed water, the HP preheater/preheaters being heated by means of turbine bleed steam, and auxiliary heat being supplied to the water/steam as a circulation medium via the heat transfer system.

Once-through steam generators are known from the publication "Kraftwerkstechnik" ["Power Station Technology"], Springer-Verlag, 2nd edition 1994, Chapter 4.4.2.4-Forced Flow (page 171 to 174), Prof. Dr.-Ing. Karl Strauss, and are used in power stations for generating electrical energy by the combustion of, for example, fossil fuels. In a once-through steam generator, the heating of the evaporator tubes forming the combustion chamber or the gas flue leads, in contrast to a natural-circulation or forced-circulation steam generator with only partial evaporation of the circulated water/steam mixture, to the evaporation of the flow medium or working medium in the evaporator tubes in a single pass.

The desire for steam generators with higher efficiencies and the development, resulting from this with regard to steam as the working medium, of the "700° C. power station" for the increase of efficiency, which, inter alia, help reduce the $CO_2$ emission into the atmosphere, lead, inter alia, to an enhancement of the steam parameters of the steam generator. Achieving or implementing higher steam parameters, that is to say higher pressures and temperatures of steam as the working medium, at the outlet for the steam generator places stringent requirements upon the steam generator itself or upon the method for operating such a steam generator. The once-through steam generators planned and constructed at the present time, with high steam parameters of up to 600° C./285 bar in relation to the fresh steam state can be implemented with the materials available or permitted at the present time and are an intermediate step to once-through steam generators with even higher steam parameters of above 650° C./approximately 320 bar in relation to the fresh steam state which are to be implemented in future.

In future power plants with a steam temperature above 650° C. (the fresh steam temperature is meant by the 650° C.), operations similar to that of 600° C. power plants is currently the principle adopted, that is to say a modified sliding pressure down to approximately 40% load and fixed pressure<approximately 40% load. On account of the higher steam parameters in the turbine or water/steam circuit, the feed water temperature rises by approximately 30 Kelvin across the preheating zone, as compared with a comparable 600° C. process or a 600° C. power plant. In spite of the economizer being designed with a low heating span, sufficient cooling at the economizer outlet under part load (<40%) can no longer be ensured in once-through operation for all possible operating states. If there were a further lowering of the load in once-through operation, the turbine controlling valve would have to be throttled, and the pressure loss under 30% load of the once-through steam generator would be approximately 40-50 bar (energy loss, wear on the turbine controlling valve during frequent operation in this load range). If throttling is not desired for the abovementioned reasons, the load range for the once-through operation of the once-through steam generator is restricted to 40-100% of full load. In power plants fired with hard coal, once-through operation of the once-through steam generator with pure coal firing is theoretically feasible up to a part load of approximately 25%. The above-described restriction to a steam generator load range of 40-100% is a disadvantage for the power station operator in terms of the flexibility of the plant, since in load situations <40% the steam generator changes to recirculation operation, which is equivalent to a temperature drop on the thick-walled components of the once-through steam generator and to an associated shortening of the service life of these components.

At the load transfer point from once-through to recirculation operation, the medium temperatures of the water/steam as working medium at the HP outlet (HP=high pressure), at the RH outlet (RH=reheater) and in the cyclone separators typically drop markedly. If the load transfer point is at about 150 bar (700° C. plant) instead of at about 100 bar (600° C. plant), the temperature drop of steam as the medium is substantially greater in the case of a comparable design of the heating surfaces. The reason for this is the different profile of the isotherms and of the saturated steam line in the wet steam region of the h-p graph.

The object of the invention, then, is to provide a method for operating a once-through steam generator operating with sliding pressure and at a steam temperature above 650° C. and for lowering its once-through minimum load, in which the abovementioned disadvantages are avoided or a lowering of the once-through minimum load to about 30% of full load is achieved. Furthermore, an object of the invention is to provide a once-through steam generator for carrying out the method.

The abovementioned object is achieved, in terms of the method, by means of the characterizing features of patent claim 1 and, in terms of the once-through steam generator for carrying out the method, by means of the characterizing features of patent claim 10.

Advantageous embodiments of the invention may be gathered from the subclaims.

By virtue of the solution according to the invention, a method for operating a once-through steam generator operating with sliding pressure and at a steam temperature above 650° C. and for lowering its once-through minimum load and also a once-through steam generator for carrying out the method are provided, which have the following advantages,

- greater flexibility for operating the once-through steam generator and therefore the power plant,
- a longer service life of the thick-walled components of the once-through steam generator,
- lower load upon the turbine controlling valve in terms of wear,
- a possible energy benefit for the overall process (instead of a pressure loss of 50 bar across the turbine controlling valve with 30° colder feed water).

What is achieved by the measures according to the invention is that the temperature rise due to the absorption of heat by the feed water downstream of the feed water pump via the HP preheaters and/or the heat transfer system is reduced by up to approximately 50 Kelvin, so that the water outlet temperature downstream of the economizer falls by up to approximately 40 Kelvin on account of the slightly improved temperature gradient on the economizer heating surface, and therefore sufficient cooling at the evaporator inlet is ensured.

In an advantageous embodiment of the invention, the reduction in heat absorption takes place by means of a controlling valve which regulates the quantity of the turbine bleed steam stream supplied to the HP preheater. The controlling valve is in this case advantageously arranged in the bleed steam line, by means of which the turbine bleed steam stream is routed from the turbine bleed point to the HP preheater. By virtue of this measure, the quantity to the HP preheater and consequently at the same time the absorption of heat by the working medium can be varied in a directed or regulated manner and the medium temperature at the economizer outlet can be influenced. The same measure can be applied to the heat transfer system in that the supply of the auxiliary heat stream is regulated by means of a controlling device and therefore at the same time the absorption of heat by the working medium is regulated. The controlling device is in this case advantageously arranged in the supply line or supply duct, by means of which the auxiliary heat stream is routed from an auxiliary source to the heat transfer system.

In an expedient manner it is possible for the reduction in heat absorption to take place by means of a controlling valve, the supply of the turbine bleed steam stream to the HP preheater or preheaters or the supply of the auxiliary heat stream to the heat transfer system being prevented completely by means of a controlling valve or controlling valves, and at least part of the working medium stream being routed past the HP preheater or past the heat transfer system by means of a bypass line. By bypassing part of the working medium stream, the pressure loss in the HP preheater or in the heat transfer system is reduced. In the event of a complete bypassing of the working medium stream, the preheater, preheaters or the heat transfer system can be shut down and put out of operation.

In an advantageous design, the reduction in heat absorption is carried out by dividing the working medium stream into two substreams ($A_{T1}$, $A_{T2}$), the first substream ($A_{T1}$) being routed through the HP preheater and the second substream ($A_{T2}$) being routed via a bypass line, and the two substreams ($A_{T1}$, $A_{T2}$) being regulated by means of at least one controlling valve. In a further advantageous design, the reduction in heat absorption is carried out by dividing the working medium stream into two substreams ($A_{T3}$, $A_{T4}$), the first substream ($A_{T3}$) being routed through the water/steam circuit-side component of the heat transfer system and the second substream ($A_{T4}$) being routed via a bypass line, and the two substreams ($A_{T3}$, $A_{T4}$) being regulated by means of at least one controlling valve. Consequently, the heat absorption of that substream quantity of the working medium which flows through the HP preheater or through the water/steam circuit-side component of the heat transfer system can be influenced by varying the substream quantity.

It is advantageous that the predetermined temperature difference $T_D$ amounts to 20 Kelvin. This ensures that evaporation at the economizer and desegregation of the circulated working medium at the inlet of the evaporator are avoided.

In an advantageous design, 50% of full load is taken as the predetermined part load point $L_T$ for reducing the heat absorption.

In an advantageous design, the heat transfer system is arranged upstream of the HP preheater, as seen in the direction of circulation of the working medium circuit. If a plurality of HP preheaters are present, in a further advantageous embodiment the heat transfer system is arranged between the HP preheaters, as seen in the direction of circulation of the working medium circuit. Finally, in a further advantageous design, the heat transfer system is arranged parallel to the HP preheater in a parallel circuit, as seen in the direction of circulation of the working medium circuit. By virtue of this measure, further heat can be supplied to the working medium for pre-heating or absorbed, from it in a simple way.

Exemplary embodiments of the invention are explained in more detail below by means of the drawing and the description.

Figure 2:
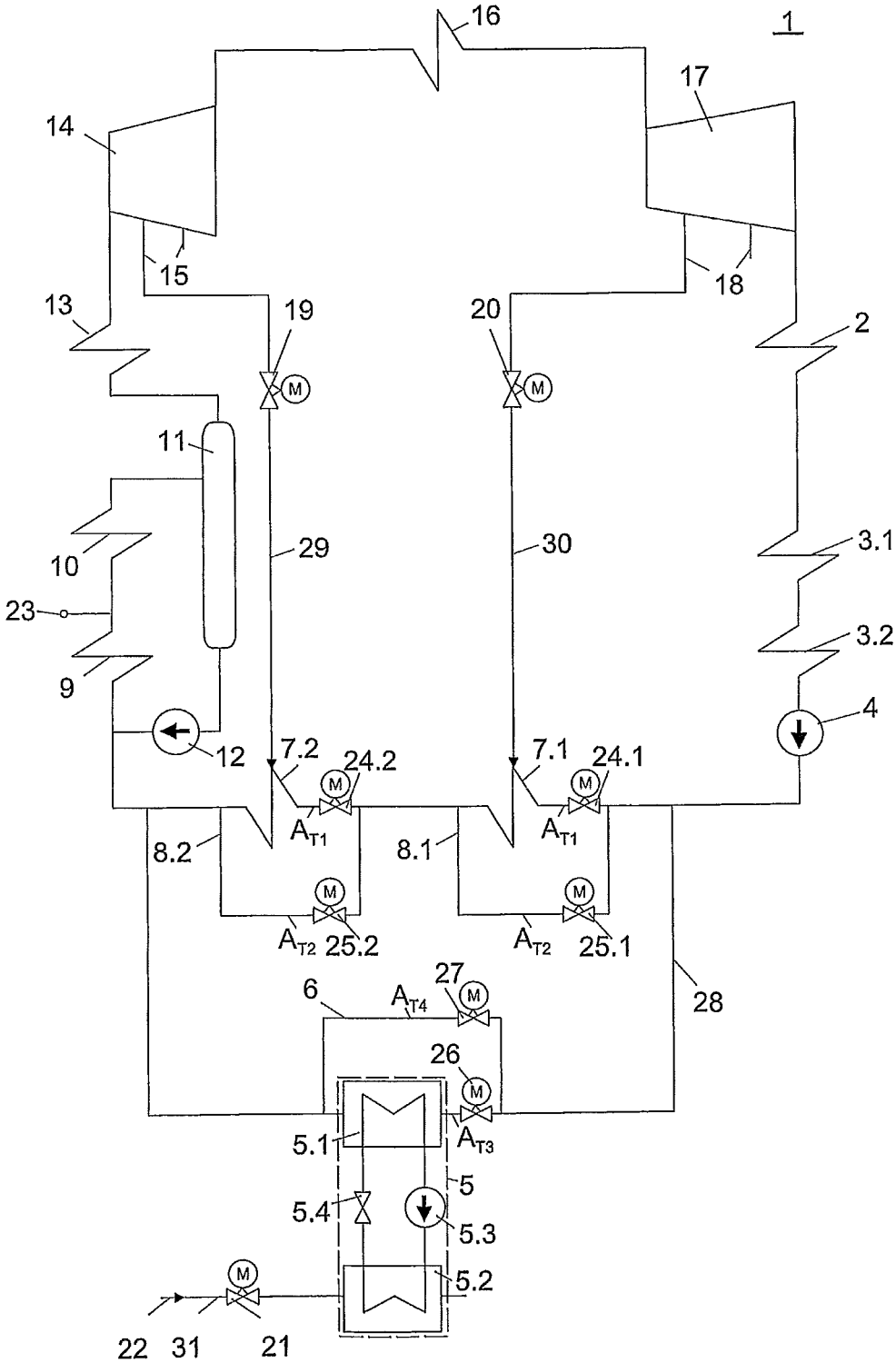
Figure 3:
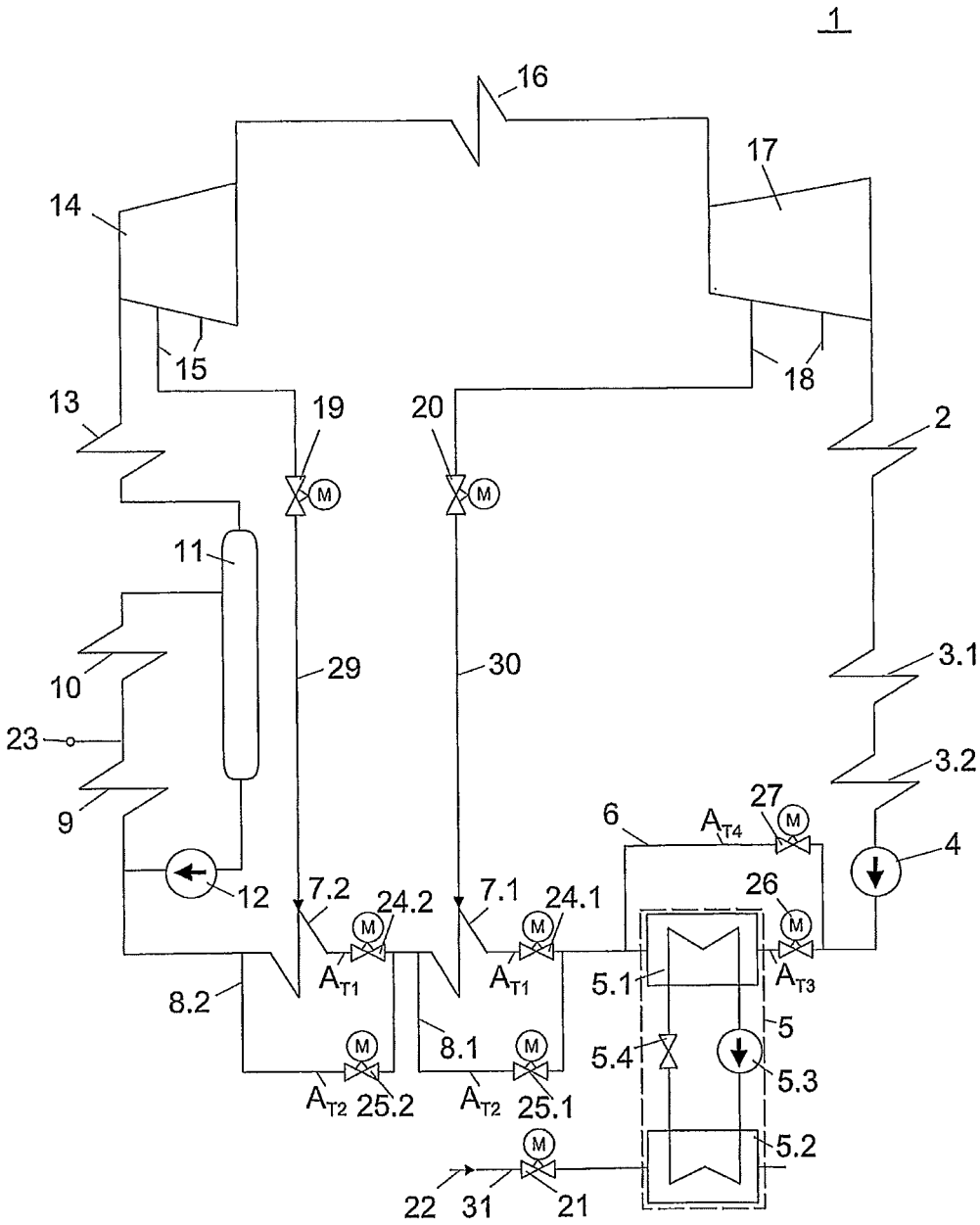
Figure 4:
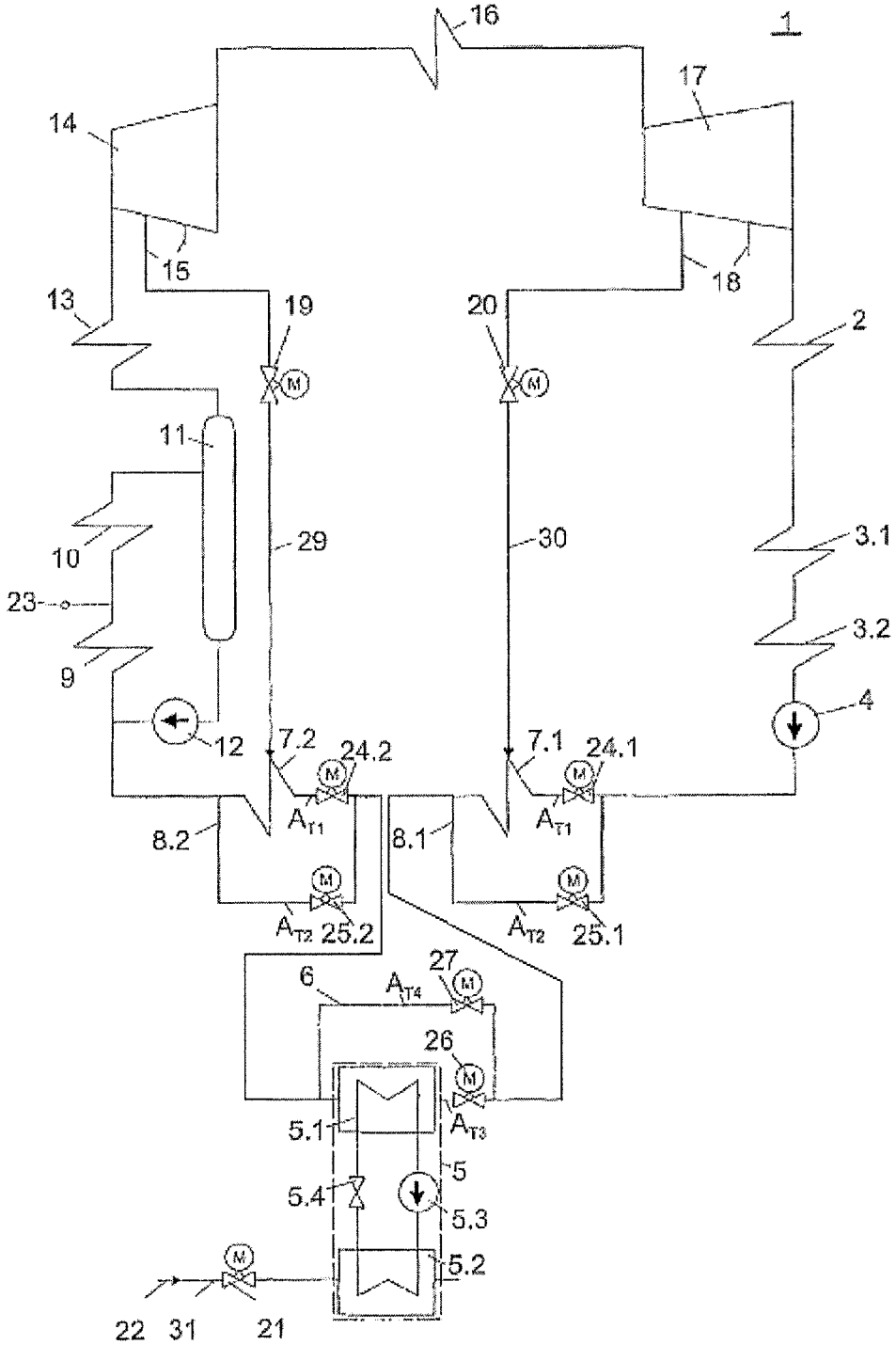

In the drawing:

FIG. 1 shows diagrammatically the water/steam circuit of a power station designed with a once-through steam generator, FIG. 2 is the same as FIG. 1, but shows an alternative version, FIG. 3 is the same as FIG. 1, but shows an alternative version, and FIG. 4 is the same as FIG. 1, but shows an alternative version.

FIG. 1 shows diagrammatically the water/steam-carrying working medium circuit 1 of a power station designed with a once-through steam generator (which in the context of the invention is to be understood as meaning the generation of steam inside the steam generator in one pass). The steam expanded in the MP/LP steam turbine (medium pressure/low pressure steam turbine) 17 is cooled in at least one condenser 2, and the condensate is subsequently heated in at least one LP preheater (low pressure preheater) 3.1, 3.2 and reintroduced into the circuit 1 by means of a feed water pump 4 or brought to the desired operating pressure. The feed water is subsequently heated further in one or more HP preheaters (high pressure preheaters) 7.1, 7.2 and in the economizer 9, is evaporated in the evaporator 10 and is subsequently superheated in the superheater 13, for example, to 700° C. The fresh steam emerging with a temperature of 700° C. from the superheater 13 is supplied to the HP steam turbine (high pressure steam turbine) 14, is partially expanded therein and is subsequently superheated once more in a reheater 16 and is supplied to the MP/LP steam turbine 17 in which the steam is as far as possible expanded before it is supplied again to the circuit 1 initially mentioned. The water/steam working medium which is routed through pipes of heating surfaces appropriately arranged in the once-through steam generator is heated in the economizer heating surfaces 9, the evaporator heating surfaces 10, the superheater heating surfaces 13 and the reheater heating surfaces 16 by flue gases which occur during the combustion of the fossil fuel in the combustion chamber, not illustrated, of the once-through steam generator. The abovementioned heating surfaces 9, 10, 13 and 16 are all arranged in the once-through steam generator either as radiant heating surfaces or as contact heating surfaces. The HP preheaters 7.1, 7.2 are heated by bleed steam which is extracted at bleeding points 15 and/or on the HP steam turbine 14 and/or on the MP/LP steam turbine 17. The LP preheaters 3.1, 3.2 can likewise be heated (not illustrated) by bleed steam from the MP/LP steam turbine 17 which can be extracted at the bleeding point 18.

The cyclone separator or cyclone separators 11 arranged between the evaporator 10 and superheater 13 serve merely for separating water not evaporated in the start-up or run-down of the once-through steam generator and in the load range below the once-through minimum load and for supplying it again to the water/steam circuit 1, upstream of the economizer 9, by means of a circulating pump 12.

In the water/steam circuit 1 according to FIGS. 2 and 3, a heat transfer system 5 is additionally integrated in the circuit 1 parallel to (see FIG. 2) or upstream of (see FIG. 3) the HP preheaters 7.1, 7.2, the heat transfer system 5 according to FIG. 2 being arranged in a parallel circuit 28 lying parallel to the circuit 1. In the arrangements according to FIGS. 2 and 3, heat for further heating the feed water is supplied to the heat transfer system 5 by means of an auxiliary heat stream 22, for example steam, flue gas or hot air, from an auxiliary source, not illustrated. The heat transfer system 5 uses a dedicated heat transfer medium which circulates inside the heat transfer system 5 by means of a circulation pump 5.3, the heat transfer medium circulation circuit also comprising a shut-off valve 5.4. An auxiliary heat stream 22 is supplied to the component 5.2 of the heat transfer system 5 by means of the supply line or supply duct (as an auxiliary heat stream in the case of flue gas or hot air) 31 and is transferred or displaced to the component 5.1, located in the circuit 1, of the heat transfer system 5 by means of the heat transfer medium, from which component the transferred heat is administered to the feed water or to the working medium of the circuit 1. The two components 5.1, 5.2 of the heat transfer system 5 therefore have in each case the function of a heat exchanger. If a plurality of HP preheaters 7.1, 7.2 are present, the heat transfer system 5 may be arranged (not illustrated) between the HP preheaters 7.1, 7.2, as seen in the direction of circulation of the working medium circuit 1.

In full load operation and also in part load operation down to a predetermined part load point $L_T$, the water/steam working medium is usually conducted through all the heating surfaces or heat exchangers, listed in FIG. 1 or FIG. 2 or FIG. 3, of the water/steam circuit 1 and is warmed or heated therein, with the exception of the condenser 2. According to the invention, if the predetermined part load point $L_T$ is undershot, the heat absorption of individual or of a plurality of HP preheaters 7.1, 7.2 and/or of the heat transfer system 5 is reduced in such a way that the temperature of the water/steam as working medium at the outlet of the economizer lies at the distance of a predetermined temperature difference $T_D$ below the boiling temperature related to the corresponding economizer outlet pressure. The feed water temperature upstream of the economizer 9 is thereby lowered by up to approximately 50 Kelvin, so that pressure throttling via the turbine controlling valve, not illustrated, to achieve sufficient cooling of the working medium carried in the circuit 1 at the economizer outlet is no longer necessary, and the fresh steam pressure can slide further downward, and therefore once-through operation of the once-through steam generator becomes possible down to a part load range of 25%, with sufficient cooling of the working medium carried in the circuit 1 at the economizer outlet for all possible operating conditions. The temperature difference $T_D$ is defined as the temperature difference of the determined boiling temperature derived from the measured medium pressure at the economizer outlet, minus the measured medium temperature at the economizer outlet.

The method according to the invention ensures that sufficient certainty is afforded in terms of preventing evaporation at the economizer 9 and desegregation of the working medium carried in the circuit 1 at the inlet of the evaporator 10, since the medium temperature at the economizer outlet has a predetermined temperature difference $T_D$ in relation to the boiling temperature at the corresponding economizer outlet pressure, and the predetermined temperature difference $T_D$ is a positive amount, the working medium temperature at the economizer outlet lying below the boiling temperature. The predetermined temperature difference $T_D$ preferably amounts to 20 Kelvin, that is to say the medium temperature at the economizer outlet preferably lies 20 Kelvin below the boiling temperature related to the corresponding economizer outlet pressure. The temperature difference $T_D$ may also amount to a minimum of 15 Kelvin or to more than 20 Kelvin.

The reduction of the heat absorption of the HP preheater or preheaters 7.1, 7.2 or of the heat transfer system 5 may in this case take place preferably in a regulated way as a function of the currently determined above-mentioned temperature difference $T_D$, in order to achieve sufficient cooling at the outlet of the economizer 9, along with optimal efficiency of the water/steam process. For this purpose, a controlling valve 19, 20 is arranged in the bleed steam line 29, 30, by means of which bleed steam is routed from the turbine bleed 15, 18 to the HP preheater 7.1, 7.2. By means of this controlling valve 19, 20, the supply quantity of the turbine bleed steam stream to the HP preheater or preheaters 7.1, 7.2 and therefore the heat absorption of the feed water or working medium downstream of the feed pump 4 can be regulated and set such that the desired feed water temperature with the predetermined temperature difference $T_D$ is achieved or is set at the economizer outlet. If, in addition to or instead of the reduction in the heat absorption of the HP preheater or preheaters 7.1, 7.2, the reduction in the heat absorption of the heat transfer system 5 is regulated, the quantity of the auxiliary heat stream 22 supplied to the heat transfer system 5 can be regulated by means of a controlling device 21 arranged in the supply line 31.

The currently determined temperature difference $T_D$ at the economizer outlet is obtained in that the current medium temperature and the current medium pressure are measured at the measuring point 23 at the economizer outlet and these two values are supplied to a process computer. The process computer determines from the determined current medium pressure the associated boiling temperature and compares this with the currently measured medium temperature. By means of this comparison, the current temperature difference $T_D$ is determined, which should have a predetermined value related to the medium pressure at the economizer outlet and which, as already stated above, should preferably amount to 20 Kelvin. If the currently determined temperature difference $T_D$ deviates from the desired value, the process computer, not illustrated, can send a corresponding controlling signal to the controlling valve or controlling valves 19, 20, 24.1. 24.2, 25.1, 25.2, 26, 27 or to the controlling device 21 in order to regulate correspondingly the reduction in heat absorption in the HP preheater or preheaters 7.1, 7.2 and/or in the heat transfer system 5.

If the currently determined temperature difference $T_D$ requires, the reduction in heat absorption at the HP preheater or preheaters 7.1, 7.2 and/or at the heat transfer system 5 can be carried out to an extent such that, by the controlling valve or controlling valves 19, 20 and/or the controlling device 21 being closed completely, heat is no longer supplied by the bleed steam stream to the HP preheater or preheaters 7.1, 7.2 or by the auxiliary heat stream to the heat transfer system 5, and therefore heat absorption also no longer takes place. In this case, by bypassing the working medium at the HP preheater or preheaters 7.1, 7.2 and/or at the heat transfer system 5, the medium-side pressure loss can be reduced, in that a substream or the entire mass stream of working medium is conducted past the above-mentioned components by means of the bypass line or bypass lines 8.1, 8.2, 6. If the complete working medium mass stream is bypassed, the HP preheater or preheaters 7.1, 7.2 and/or the heat transfer system 5 can be shut down. For this purpose, with regard to the HP preheater or preheaters 7.1, 7.2, the controlling valve or controlling valves 25.1, 25.2 are opened and the controlling valve or controlling valves 24.1, 24.2 are closed and, with regard to the heat transfer system 5, the controlling valve 27 is opened and the controlling valve 26 is closed. The shutdown of the heat transfer system 5 may take place either in addition to or instead of the shutdown of the HP preheaters 7.1, 7.2.

Furthermore, the reduction in heat absorption within the HP preheater or preheaters 7.1, 7.2 and/or within the heat transfer system 5 may be carried out by dividing the working medium stream into two substreams $A_{T1}$, $A_{T2}$ and/or $A_{T3}$, $A_{T4}$, the first substream $A_{T1}$ being routed through the HP preheater or preheaters 7.1, 7.2 and/or $A_{T3}$ being routed through the heat transfer system 5 (to be precise, through the component 5.1, located in the circuit 1, of the heat transfer system 5), and the second substream $A_{T2}$ being routed via a bypass line 8.1, 8.2 of the respective HP preheater and/or $A_{T4}$ being routed via a bypass line 6 of the heat transfer system 5. The two substreams $A_{T1}$, $A_{T2}$ may in this case be regulated by means of at least one controlling valve 24.1, 24.2, 25.1, 25.2 which lies either directly upstream or directly downstream (not illustrated) of the HP preheater or preheaters 7.1, 7.2 or is arranged in the respective bypass line 8.1, 8.2. That is to say, with regard to the HP preheater or preheaters 7.1, 7.2, either the substream $A_{T1}$ is regulated by the controlling valve 24.1, 24.2 arranged directly upstream or directly downstream (not illustrated) of the HP preheater or preheaters 7.1, 7.2 or the substream $A_{T2}$ is regulated by the controlling valve 25.1, 25.2 arranged in the bypass line 8.1, 8.2 or both substreams $A_{T1}$, $A_{T2}$ are regulated by the controlling valves 24.1, 24.2, 25.1, 25.2. In the case of a plurality of HP preheaters 7.1, 7.2, the substreams $A_{T1}$ may be different in terms of the substream quantity in the respective HP preheaters 7.1, 7.2, which then logically also applies to the substreams $A_{T2}$ in the respective bypass lines 8.1, 8.2 of the HP preheaters 7.1, 7.2.

As regards the heat transfer system 5, either the substream $A_{T3}$ is regulated by the controlling valve 26 arranged directly upstream or directly downstream (not illustrated) of the component 5.1 of the heat transfer system 5 or the substream $A_{T4}$ is regulated by the controlling valve 27 arranged in the bypass line 6 or both substreams $A_{T3}$, $A_{T4}$ are regulated by the controlling valves 26, 27. The controlling valves can obtain, for example from a processor, not illustrated, the corresponding control variables which the processor determines or prepares from the data which it acquires from the measuring point 23 at the economizer outlet. By the variation of the quantity of the working medium stream flowing through the HP preheater 7.1, 7.2 and/or through the component 5.1 of the heat transfer system 5, the heat absorption of this substream can be varied or regulated at the same time.

The reduction in heat absorption within the HP preheater or preheaters 7.1, 7.2 by means of the controlling valves 24.1, 24.2, 25.1, 25.2 may take place with or without the inclusion of the controlling valves 19, 20 which regulates the supply quantity of the bleed steam stream to the HP preheater or preheaters 7.1, 7.2. Furthermore, the reduction in heat absorption within the component 5.1 of the heat transfer system 5 may take place by means of the controlling valves 26, 27 with or without the inclusion of the controlling device 21 which regulates the supply quantity of the auxiliary heat stream 22 to the component 5.2 of the heat transfer system 5. In addition to the controlling device 21, there is, within the heat transfer system 5, the possibility of closing the shut-off valve 5.4 of the heat transfer medium circulation circuit and of switching off the circulation pump 5.3 in order to prevent the supply of heat to the component 5.1 of the heat transfer system 5, this being equivalent to shutting down the heat transfer system 5 and the heat absorption by the working medium in the heat transfer system 5.

Preferably 50% of full load can be taken as the predetermined part load point $L_T$ for reducing the heat absorption in at least one of the HP preheaters 7.1, 7.2 and/or in the heat transfer system 5. If this part load point $L_T$ is undershot, the heat absorption in one or more of the HP preheaters 7.1, 7.2 and/or in the heat transfer system 5 is then reduced according to the invention, as described above. However, the predetermined part load point $L_T$ may also be in the range of between 40 and 60% of full load.

The once-through operation of the once-through steam generator down to a part load range of 25% avoids the situation where once-through operation has to be changed to recirculation operation within the part load range of the once-through steam generator, and therefore, at its load transfer point, the working medium temperatures at the HP outlet (fresh steam outlet at the superheater 13), at the RH outlet (reheater steam outlet at the reheater 16) and in the cyclone separators 11 no longer drop so sharply. Furthermore, the throttling of the turbine controlling valves and their wear are avoided. The displacement of the load transfer point to lower load leads to lower temperature drops at the thick-walled components on account of the profile of the isotherms and saturated steam line in the h-p graph.

LIST OF REFERENCE SYMBOLS

1 Water/steam or working medium circuit
2 Condenser
3.1 LP preheater
3.2 LP preheater
4 Feed water pump
5 Heat transfer system
5.1 Component
5.2 Component
5.3 Circulation pump
5.4 Shut-off valve
6 Bypass line
7.1 HP preheater
7.2 HP preheater
8.1 Bypass line
8.2 Bypass line
9 Economizer
10 Evaporator
11 Cyclone separator
12 Circulating pump
13 Superheater
14 HP steam turbine
15 Bleeds on HP turbine
16 Reheater
17 MP/LP steam turbine
18 Bleeds on MP/LP turbine
19 Controlling valve for bleed steam of HP turbine
20 Controlling valve for bleed steam of MP/LP turbine
21 Controlling device for auxiliary heat
22 Auxiliary heat stream
23 Measuring point at the economizer outlet
24.1 Controlling valve
24.2 Controlling valve
25.1 Controlling valve
25.2 Controlling valve
26 Controlling valve
27 Controlling valve
28 Parallel circuit to circuit 1 in the region of the HP preheaters
29 Bleed steam line
30 Bleed steam line
31 Supply line or supply duct

The invention claimed is:

1. A method for operating a once-through steam generator operating with sliding pressure and at a steam temperature above 650° C. and for lowering its forced-flow minimum load, the once-through steam generator being incorporated into a water/steam-carrying working medium circuit of a power station, and an economizer of the once-through steam generator having upstream, as seen in the working medium circulation direction, at least one HP preheater and one heat transfer system for preheating the working medium, the working medium absorbing heat from a supplied turbine bleed steam stream within the HP preheater or preheaters and absorbing heat from a supplied auxiliary heat stream in the heat transfer system, the method comprising:

reducing, if a predetermined part load point is undershot, the heat absorption of the working medium within at least one HP preheater and the heat transfer system so that the temperature of the water/steam as a working medium at the outlet of the economizer lies at a distance of a predetermined temperature difference below the boiling temperature related to the corresponding economizer outlet pressure, wherein the reduction in heat absorption is performed by a controlling device, the supply of the auxiliary heat stream to the heat transfer system being prevented completely by the controlling device, and at least part of the water/steam working medium stream being routed past a component located in the water/steam circuit of the heat transfer system by a bypass line.

2. The method as claimed in claim 1, wherein the reduction in heat absorption is performed by a controlling valve which regulates the quantity of the turbine bleed steam stream supplied to the HP preheater.

3. The method as claimed in claim 1, wherein the reduction in heat absorption is performed by a controlling valve, the supply of the turbine bleed steam stream to the HP preheater being prevented completely by the controlling valve, and at least part of the water/steam working medium stream being routed past the HP preheater by means of a bypass line.

4. The method as claimed in claim 1, wherein the reduction in heat absorption is carried out by dividing the working medium stream into two substreams a first substream being routed through the HP preheater and a second substream being routed via a bypass line of the HP preheater, and the two substreams being regulated by at least one controlling valve.

5. The method as claimed in claim 1, wherein the reduction in heat absorption is performed by a controlling device which regulates a quantity of the auxiliary heat stream supplied to the heat transfer system.

6. A method for operating a once-through steam generator operating with sliding pressure and at a steam temperature above 650° C. and for lowering its forced-flow minimum load, the once-through steam generator being incorporated into a water/steam-carrying working medium circuit of a power station, and an economizer of the once-through steam generator having upstream, as seen in the working medium circulation direction, at least one HP preheater and one heat transfer system for preheating the working medium, the working medium absorbing heat from a supplied turbine bleed steam stream within the HP preheater or preheaters and absorbing heat from a supplied auxiliary heat stream in the heat transfer system, the method comprising:

reducing, if a predetermined part load point is undershot, the heat absorption of the working medium within at least one HP preheater and the heat transfer system so that the temperature of the water/steam as a working medium at the outlet of the economizer lies at a distance of a predetermined temperature difference below the boiling temperature related to the corresponding economizer outlet pressure, wherein the reduction in heat absorption is carried out by dividing the working medium stream into two substreams, a first substream being routed through the water/steam circuit-side component of the heat transfer system and a second substream being routed via a bypass line of the heat transfer system, and the two substreams being regulated by at least one controlling valve.

7. The method as claimed in claim 1, wherein the predetermined temperature difference is 20 Kelvin.

8. The method as claimed in claim 1, 50% of full load is taken as the predetermined part load point.

9. A once-through steam generator operable with sliding pressure and at a steam temperature above 650° C. and suitable for lowering the once-through minimum load, the once-through steam generator being incorporated into a water/steam-carrying working medium circuit of a power station, the once-through steam generator comprising:

an economizer having upstream, as seen in the working medium circulation direction, at least one HP preheater and one heat transfer system for preheating the working medium, heat being capable of being absorbed by the working medium within the HP preheater or preheaters from a turbine bleed steam stream supplied by at least one bleed steam line and heat being capable of being absorbed by the working medium in the heat transfer system from an auxiliary heat stream supplied by a supply line, wherein, if a predetermined part load point is undershot, the heat absorption of the working medium within at least one HP preheater and the heat transfer system can be reduced so that the temperature of the water/steam as a working medium at the outlet of the economizer can be set at the distance of a predetermined temperature difference below the boiling temperature related to the corresponding economizer outlet pressure, and wherein the heat transfer system has a bypass line.

10. The once-through steam generator as claimed in claim 9, wherein the at least one bleed steam line is designed for controlling the turbine bleed steam stream by a controlling valve and/or the supply line for auxiliary heat is designed for controlling the auxiliary heat stream by a controlling device.

11. The once-through steam generator as claimed in claim 9, wherein the heat transfer system is arranged upstream of the HP preheater, as seen in the direction of circulation of the working medium circuit.

12. The once-through steam generator as claimed in claim 9, wherein, if a plurality of HP preheaters are present, the heat transfer system is arranged between the HP preheaters, as seen in the direction of circulation of the working medium circuit.

13. The once-through steam generator as claimed in claim 9, wherein the heat transfer system is arranged parallel to the HP preheater in a parallel circuit, as seen in the direction of circulation of the working medium circuit.

14. The once-through steam generator as claimed in claim 9, wherein the HP preheater has a bypass line.

15. The once-through steam generator as claimed in claim 9, wherein the HP preheater has a controlling valve upstream or downstream of the HP preheater, as seen in the direction of circulation of the working medium circuit.

16. The once-through steam generator as claimed in claim 9, wherein the heat transfer system has a controlling valve upstream or downstream of the heat transfer system, as seen in the direction of circulation of the working medium circuit.

17. The once-through steam generator as claimed in claim 14, wherein the bypass line has a controlling valve.

* * * * *